US005197890A

United States Patent [19]

Seymour

[11] Patent Number: 5,197,890

[45] Date of Patent: Mar. 30, 1993

[54] HYDRODYNAMIC ELECTRICAL CONNECTOR

[75] Inventor: Douglas G. Seymour, Warren, Pa.

[73] Assignee: GTE Products Corporation, Danvers, Mass.

[21] Appl. No.: 818,937

[22] Filed: Jan. 10, 1992

[51] Int. Cl.[5] ..... H01R 13/15

[52] U.S. Cl. ..... 439/77; 439/67; 439/197

[58] Field of Search ..... 439/77, 197, 260, 67

[56] References Cited

U.S. PATENT DOCUMENTS

| | | | |
|---|---|---|---|
| 2,956,258 | 10/1960 | Raddin | 339/75 |
| 2,978,666 | 4/1961 | McGregor | 339/17 |
| 3,076,166 | 1/1963 | Raddin | 339/17 |
| 3,090,026 | 5/1963 | Raddin | 339/17 |
| 3,596,228 | 7/1971 | Reed et al. | 339/59 |
| 3,941,446 | 3/1976 | Cantwell | 339/75 M |
| 4,220,389 | 9/1980 | Schell | 439/197 |
| 4,850,889 | 7/1989 | LaSots | 439/262 |
| 4,886,461 | 12/1989 | Smith | 439/67 |
| 4,968,265 | 11/1990 | Fox, Jr. | 439/197 |
| 5,002,496 | 3/1991 | Fox, Jr. | 439/197 |

*Primary Examiner*—Gary F. Paumen
*Attorney, Agent, or Firm*—William H. McNeill

[57] ABSTRACT

An electrical connector assembly comprising a first body part having a first surface and a second surface normal thereto. The second surface contains a plurality of electrically conductive traces thereon in a particular spacing array. A first hinge half projects from the first surface. A flexible printed circuit board having a plurality of electrically conductive ribs in said particular spacing array is adjacent said second surface, said ribs being in contact with said traces. A second body part has a third surface and a fourth surface normal thereto, said third surface carrying a second hinge half in mating engagement with the first hinge half. The fourth surface carries a plurality of springs in substantially the same particular spacing array as the traces and ribs, each of the springs of the plurality of springs presenting a protuberant portion extending toward the flexible printed circuit board whereby a concavity exits on the side of said springs away from the flexible printed circuit board. A fluid filled bladder is positioned in the concavity. A Hertz dot is positioned at the apex of each of the protuberant portions of each of the springs of the plurality of springs and locking means are provided which maintain the second body part in engagement with the first body part.

4 Claims, 3 Drawing Sheets

HYDRODYNAMIC ELECTRICAL CONNECTOR

TECHNICAL FIELD

This invention relates to electrical connectors and more particularly to such connectors employing hydraulic fluid filled bladders to provide hydrodynamic pressure to spring contacts.

BACKGROUND ART

The general use of fluid filled bladders as a means of applying a particular force in electrical connectors is well known, as can be seen from U.S. Pat. Nos. 2,956,258; 2,978,666; 3,076,166; 3,596,228; 3,941,446; 4,850,889; 4,886,461; 4,968,265; and 5,002,496. All of the solutions represented above tend to be large and cumbersome and difficult to use, even though some of them provide for an increased density of electrical contacts. Further, the pressures employed are very high, since it is the hydraulic bladder alone that is supplying the pressure to make electrical contact. These hydraulic pressures are generally over 500 lbs/sq. in. in order to achieve a normal force of 80 grams/contact. A need is arising for an economical and simple construction of high density electrical connectors for use in automotive environments where great temperature extremes may be encountered.

These connectors or modules are increasingly demanded to be more and more sophisticated while not increasing in size.

Advanced interconnects will begin to evolve with the introduction of these more complex control module designs. Essential to their operation will be connectors of increased circuit density and electrical performance. System signal integrity will have to be maintained as the connectors become the gating element in high-speed electronic module performance. Impedance and cross-talk characteristics will become prime considerations in connector selection.

DISCLOSURE OF THE INVENTION

Accordingly, it is an object of this invention to obviate the disadvantages of the prior art.

It is another object of the invention to enhance interconnects.

Yet another object of the invention is the provision of an electrical connector having high density combined with ease of operation and high reliability in hostile environments.

Still another object of the invention is the provision of a hydrodynamic connector utilizing very low hydraulic pressures; i.e., in the order of 10 lbs/sq. in.

These objects can be accomplished, and solutions for tomorrow's electronic system requirements can be provided, by a hydrodynamic connector system which can be integrated with three-dimensional (3-D) molded circuit technology. The 3-D molded circuit board (MCB) is one device that can hold down both the weight and size of a module design. MCBs accommodate surface-mounted devices (SMDs) quite handily, thus reducing the overall size of an MCB. This, coupled with increased reliability, could reduce costs while improving system quality.

A hydrodynamic connector hinged onto the MCB would provide an advanced interconnect solution, which the introduction of high-speed signal processing will require. This type of connector system uses the advantages of hydraulics to ensure uniform contact pressure across each circuit, regardless of connector density. A contact spring which includes a Hertz dot feature and, by itself can provide a normal force of 100 grams/contact, is sandwiched between the hydraulics and the harness circuitry. The Hertz dot defines both the contact area and location, while the dynamic loading is applied by the hydraulics. This ensures uniform contact pressure, even when conditions change in the engine compartment environment. No longer is connector density limited by the miniaturization of the conventional pin and socket design. It is now simple to achieve extremely fine connector pitch by accurately registering the flexible circuitry to the MCB. A hydraulic bladder, supporting a stainless steel contact spring, precisely maintains the normal force. Even when there are mechanical variations within the contact spring members, the hydraulic bladder equalizes contact normal force by applying uniform reaction force loading. As environmental conditions dictate, this hydraulic reaction force loading compensates dynamically for further mechanical variability at the connector interface. Since the hydraulic bladder is not being utilized to make the electrical contact, the force applied can be low, reducing the danger of rupture.

MCBs allow the designer to rethink the design of circuit boards, assembly, electrical/electronic discrete components, connectors and specialty interconnection devices. Features such as standoffs, busses or connectors can be molded into the device, delivering immense design flexibility. This flexibility in turn can reduce the number of components, simplify assembly operations, reduce inventory and purchasing functions, while contributing to the overall system-level savings in the net cost of assembly.

The hydrodynaminc connector of this invention allows the utilization of advanced MCBs.

BEST MODE FOR CARRYING OUT THE INVENTION

Figure 1:
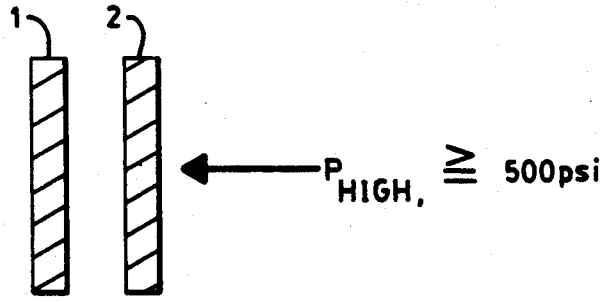
FIG. 1 PRIOR ART
FIG. 1 is a diagrammatic view of prior art devices employing hydraulic pressures in a static mode.

For a better understanding of the present invention, together with other and further objects, advantages and capabilities thereof, reference is made to the following disclosure and appended claims taken in conjunction with the above-described drawings Referring now to the drawings there is illustrated diagrammatically in FIG. 1 a generalization of prior art hydraulic connectors. Therein, contacts 1 and 2 are brought together by the pure application of hydraulic pressure which can be in the neighborhood of 500 lbs/sq. in. See, for example, U.S. Pat. No. 4,968,265, wherein a hydraulic pressure of 508 lbs/sq. in. is provided to achieve a normal force of 80 grams/contact.

Figure 2:
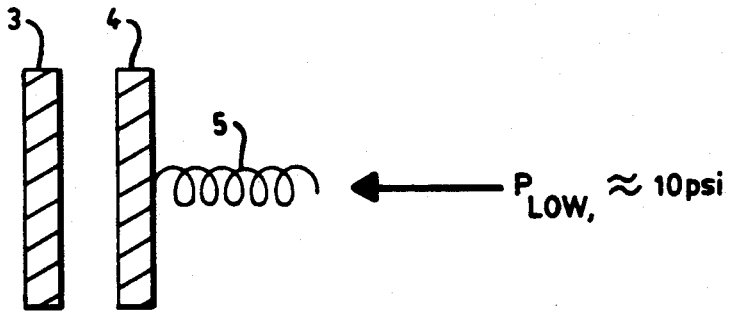
FIG. 2 is a diagrammatic view illustrating the principles of an embodiment of the instant invention.

In contrast, the principles of the instant invention are illustrated in FIG. 2 wherein contacts 3 and 4 are brought together by the action of a spring 5. The latter is dynamically regulated by the presence of a hydraulic bladder which applies a pressure of about 10 lbs/sq. in.

Figure 3:
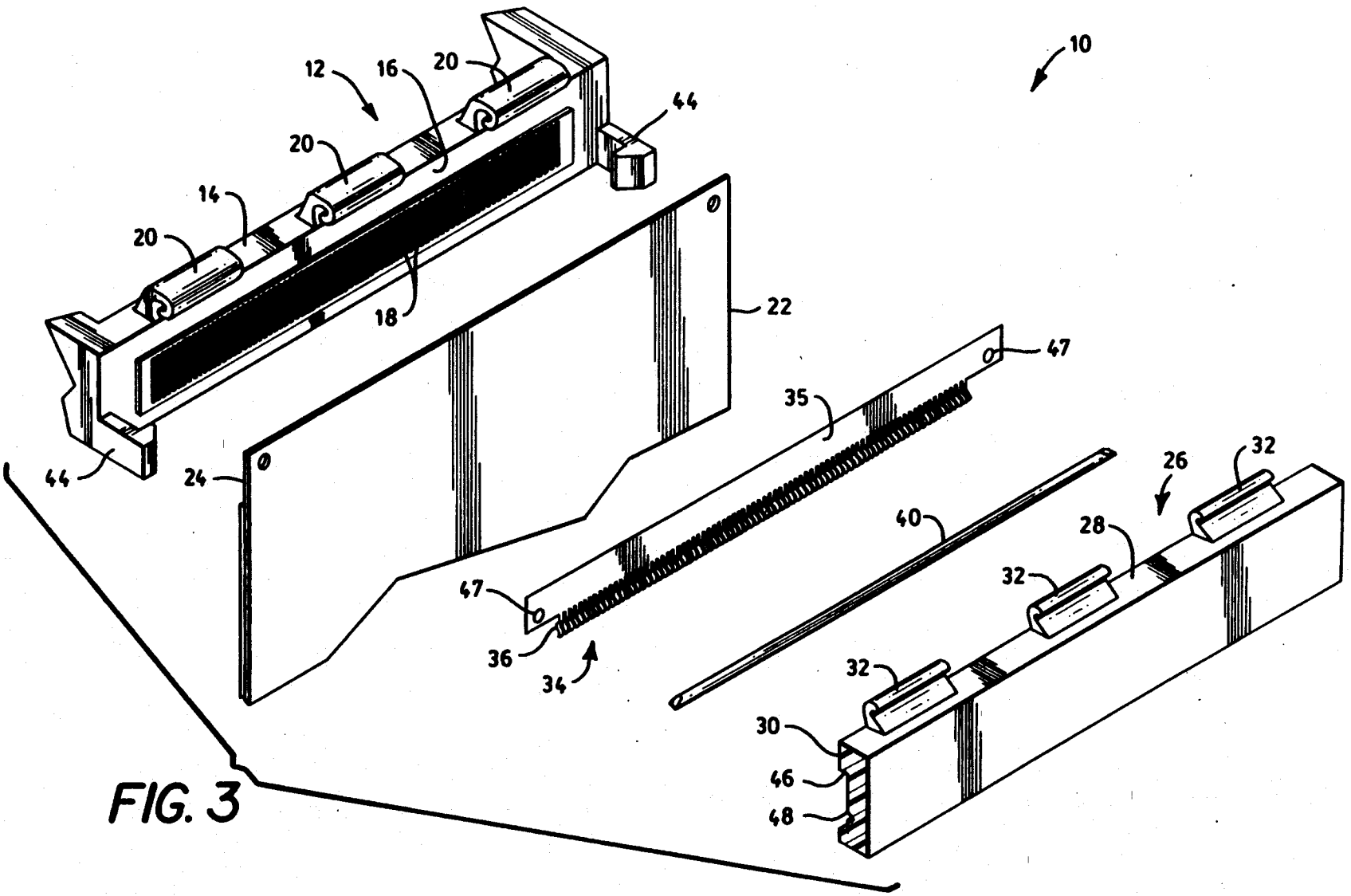
FIG. 3 is an exploded, perspective view of an embodiment of the invention.

Still more particularity, there is shown in FIG. 3 an electrical connector assembly 10 utilizing the latter concept. The connector assembly 10 has a first body part 12 having a first surface 14 and a second surface 16 normal thereto. The first body part can carry a 3-D MCB, which is not shown. The second surface 16 contains a plurality of electrically conductive traces 18 in a particular spacing array. A first hinge half 20 projects from the first surface 12. In the illustrated embodiment three such halves 20 are shown.

A flexible printed circuit board 22 having a plurality of electrically conductive ribs 24 thereon (only one rib 24 being shown) is positioned adjacent to the second surface 16. The ribs 24 have the same spacing array as the traces and are in contact therewith.

Figure 4:
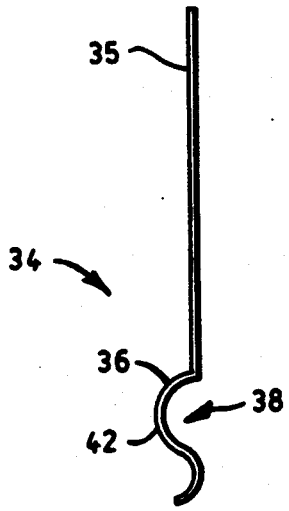
FIG. 4 is a side elevational view of a spring employed with the invention.
Figure 5:
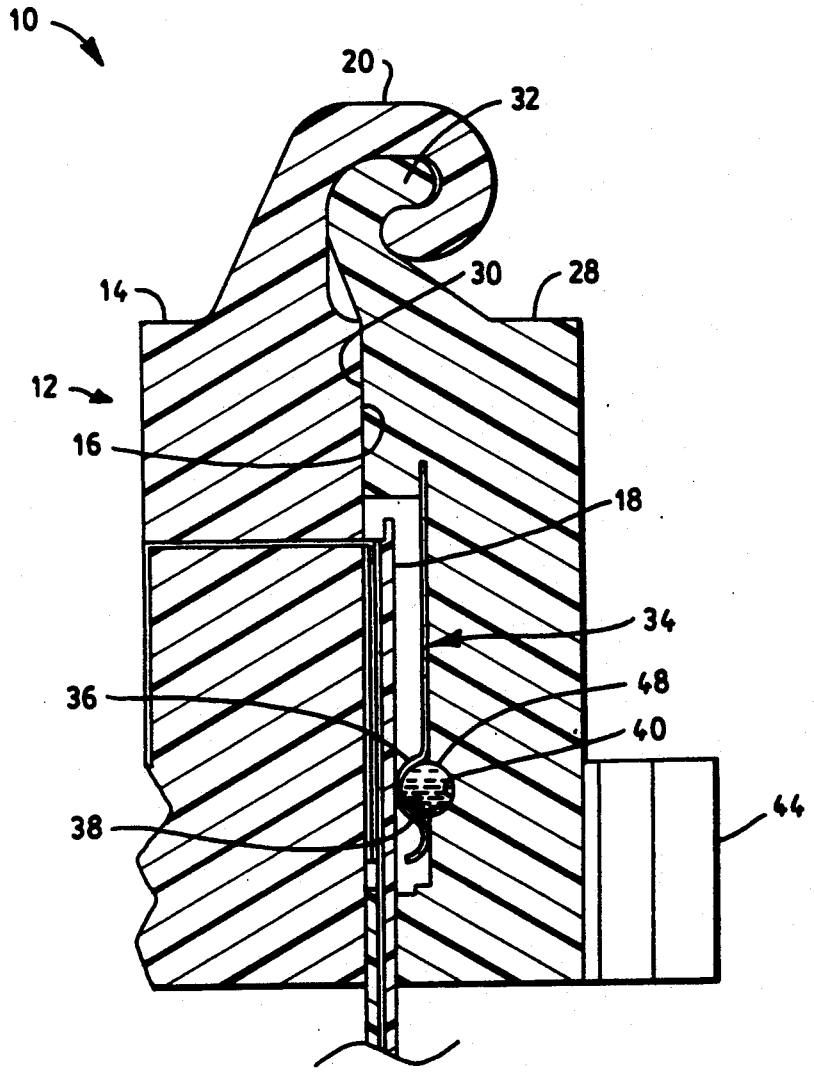
FIG. 5 is a cross-sectional elevational view of the connector in an assembled position.

A second body part 26 completes the assembly 10. Second body part 26 has a third surface 28 and a fourth surface 30 normal thereto. The third surface 28 carries a second hinge half 32 which mates with first hinge half 20. As noted above, in the illustrated embodiment, three hinge halves are shown. Fourth surface 30 carries a plurality of springs 34 in substantially the same particular spacing array as the traces and ribs. Since the springs provide only pressure and do not carry any electrical energy, it is not necessary that they be insulated from each other and all may depend from a common limb 35. Each of the springs, which are preferably constructed from stainless steel, has a protuberant portion 36 which extends toward the flexible printed circuit board 22, whereby a concavity 38 exists on the side of the spring away from the board 22 (see FIG. 4). A fluid filled bladder 40 is positioned in the concavity 38, as best seen in FIG. 5. A Hertz dot 42 is positioned at the apex of each protuberant portion 36 of each spring 34. Locking means 44, which extend from first body part 12, engage the second body part 26 and maintain the engagement of the parts under pressure.

In the preferred form of the invention, the concavity 38 is semi-circular and the fourth surface 30 is provided with a recess 46 for receiving the springs 34, which may be held in position by means of studs or screws (not shown) which would utilize apertures 47 in limb 35.

Ideally, the first recess 46 would be provided with a second recess 48 which is semi-circular and aligned with the concavity 38 in springs 34. In such a case the bladder 40 is cylindrical and substantially fills the space formed by the concavity 38 and the second recess 48.

Bladder 40 can be constructed from polypropylene tubing and, while it can be pneumatic, a hydraulic fluid such as a conventional brake fluid, is preferred. The body parts can be formed from any thermoplastic material, thus avoiding the use and expense of metallic parts. The bladder 40 should be sufficiently oversized to provide a pressure of about 10 psi across the springs 34 when the connector is assembled.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. An electrical connector assembly comprising:

a first body part having a first surface and a second surface normal thereto, said second surface containing a plurality of electrically conductive traces thereon in a particular spacing array;

a first hinge half projecting from said first surface;

a flexible printed circuit board having a plurality of electrically conductive ribs in said particular spacing array adjacent said second surface, said ribs being in contact with said traces;

a second body part having a third surface and a fourth surface normal thereto, said third surface carrying a second hinge half in mating engagement with said first hinge half; said fourth surface carrying a plurality of springs in substantially the same particular spacing array as said traces and ribs, each of the springs of said plurality of springs presenting a protuberant portion extending toward said flexible printed circuit board whereby a concavity exists on the side of said springs away from said flexible printed circuit board; a fluid filled bladder positioned in said concavity; a Hertz dot positioned at the apex of each of said protuberant portions of each of said springs of said plurality of springs; and locking means maintaining said second body part in engagement with said first body part.

2. The electrical connector assembly of claim 1 wherein said concavity is semi-circular.

3. The electrical connector assembly of claim 2 wherein said fourth surface is provided with a first recess for receiving said plurality of springs.

4. The electrical connector assembly of claim 3 wherein said first recess is provided with a second recess which is semi-circular and aligned with said concavity in said springs; and said bladder is cylindrical and substantially fills said concavity in said spring and said second recess.

* * * * *